US009242341B2

(12) United States Patent
Lin et al.

(10) Patent No.: US 9,242,341 B2
(45) Date of Patent: Jan. 26, 2016

(54) CMP HEAD STRUCTURE

(71) Applicant: GLOBALFOUNDRIES Singapore Pte. Ltd., Singapore (SG)

(72) Inventors: Benfu Lin, Singapore (SG); Wei Lu, Singapore (SG); Alex See, Singapore (SG)

(73) Assignee: GLOBALFOUNDRIES Singapore Pte. Ltd., Singapore (SG)

( * ) Notice: Subject to any disclaimer, the term of this patent is extended or adjusted under 35 U.S.C. 154(b) by 0 days.

(21) Appl. No.: 14/059,451

(22) Filed: Oct. 22, 2013

(65) Prior Publication Data

US 2015/0111467 A1 Apr. 23, 2015

(51) Int. Cl.

| | |
|---|---|
| ***B24B 49/00*** | (2012.01) |
| ***B24B 37/005*** | (2012.01) |
| ***B24B 37/32*** | (2012.01) |

(52) U.S. Cl.

CPC ..... *B24B 49/00* (2013.01); *B24B 37/005* (2013.01); *B24B 37/32* (2013.01)

(58) Field of Classification Search

CPC .... B24B 7/228; B24B 37/005; B24B 37/042; B24B 37/32; B24B 49/00

See application file for complete search history.

(56) References Cited

U.S. PATENT DOCUMENTS

| | | | | |
|---|---|---|---|---|
| 6,012,964 | A * | 1/2000 | Arai et al. | 451/5 |
| 6,390,908 | B1 * | 5/2002 | Chen et al. | 451/398 |
| 6,939,202 | B2 * | 9/2005 | Heidrich et al. | 451/9 |
| 9,017,138 | B2 * | 4/2015 | Chen et al. | 451/5 |
| 2007/0243796 | A1 * | 10/2007 | Torii | 451/5 |

* cited by examiner

*Primary Examiner* — Timothy V Eley

(74) *Attorney, Agent, or Firm* — Horizon IP Pte. Ltd.

(57) ABSTRACT

A CMP structure for CMP processing and a method of making a device using the same are presented. The apparatus comprises a polishing pad on a platen table; a head assembly for holding a wafer against the polishing pad, wherein the head assembly includes the retaining ring; a sensor for sensing the step height between the retaining ring and its membrane and a controller for adjusting the movement of the retaining ring based on the step height between the retaining ring and its membrane to ensure the step height remains at a fixed value as the retaining ring wears out.

20 Claims, 6 Drawing Sheets

CMP HEAD STRUCTURE

BACKGROUND

The fabrication of integrated circuits (ICs) involves the formation of features on a substrate that make up circuit components, such as transistors, resistors and capacitors. The devices are interconnected, enabling the ICs to perform the desired functions. An important aspect of the manufacturing of ICs is the need to provide planar surfaces using chemical mechanical polishing (CMP).

CMP tools generally include a platen with a polishing pad. A wafer carrier including a polishing head is provided. The polishing head holds the wafer so that the wafer surface that is to be polished faces the polishing pad. During polishing, the polishing head presses the wafer surface against a rotating polishing pad. A retaining ring holds the wafer in place by centering the wafer on the polishing pad and preventing the wafer from slipping laterally. During the CMP process, material is not only removed from the surface of the wafer to be planarized, but also from the polishing side surface of the retaining ring. This results in the decrease in the depth of grooves that are present on the side surface of the retaining ring, which could result in non-uniformity in the CMP process. As such, the retaining ring may need to be replaced frequently to maintain the desired uniformity.

As the polishing tool has to be taken offline when replacing the retaining ring, it could become quite costly to replace the retaining ring. Hence, there is a need for a CMP method and apparatus that could prolong the life of the retaining ring thereby reducing the cost of semiconductor processing.

SUMMARY

Embodiments generally relate to a CMP structure with an improved retaining ring life span for use in CMP and the use of such structure for forming semiconductor devices.

In one embodiment, the structure includes an apparatus for prolonging the use of a retaining ring. The apparatus comprises a polishing pad on a platen table; a head assembly for holding a wafer against the polishing pad, wherein the head assembly includes the retaining ring; a sensor for sensing the step height between the retaining ring and its membrane and a controller for adjusting the movement of the retaining ring based on the step height between the retaining ring and its membrane to ensure the step height remains at a fixed value as the retaining ring wears out.

In another embodiment, a method for prolonging the use of a retaining ring comprises providing a head assembly for use in polishing a wafer, wherein the head assembly includes a retaining ring for holding the wafer in place on a polishing pad; determining the step height between the retaining ring and a membrane; calculating how much the retaining ring should be moved to ensure the step height between the retaining ring and the membrane remains a fixed value; and moving the retaining ring to ensure the step height remains at the fixed value as the retaining ring wears out.

In yet another embodiment, a method for forming a device comprises providing a wafer; processing the wafer, wherein processing the wafer includes providing a head assembly for use in polishing the wafer, wherein the head assembly includes a retaining ring for holding the wafer in place on a polishing pad, determining the step height between the retaining ring and its membrane, and calculating how much the retaining ring should be moved to ensure the step height between the retaining ring and the membrane remains at a fixed value and moving the retaining ring to ensure the step height remains at the fixed value.

These advantages and features of the embodiments herein disclosed will become apparent through reference to the following description and the accompanying drawings. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles. Various embodiments are described with reference to the following drawings, in which.

DESCRIPTION

Figure 1:
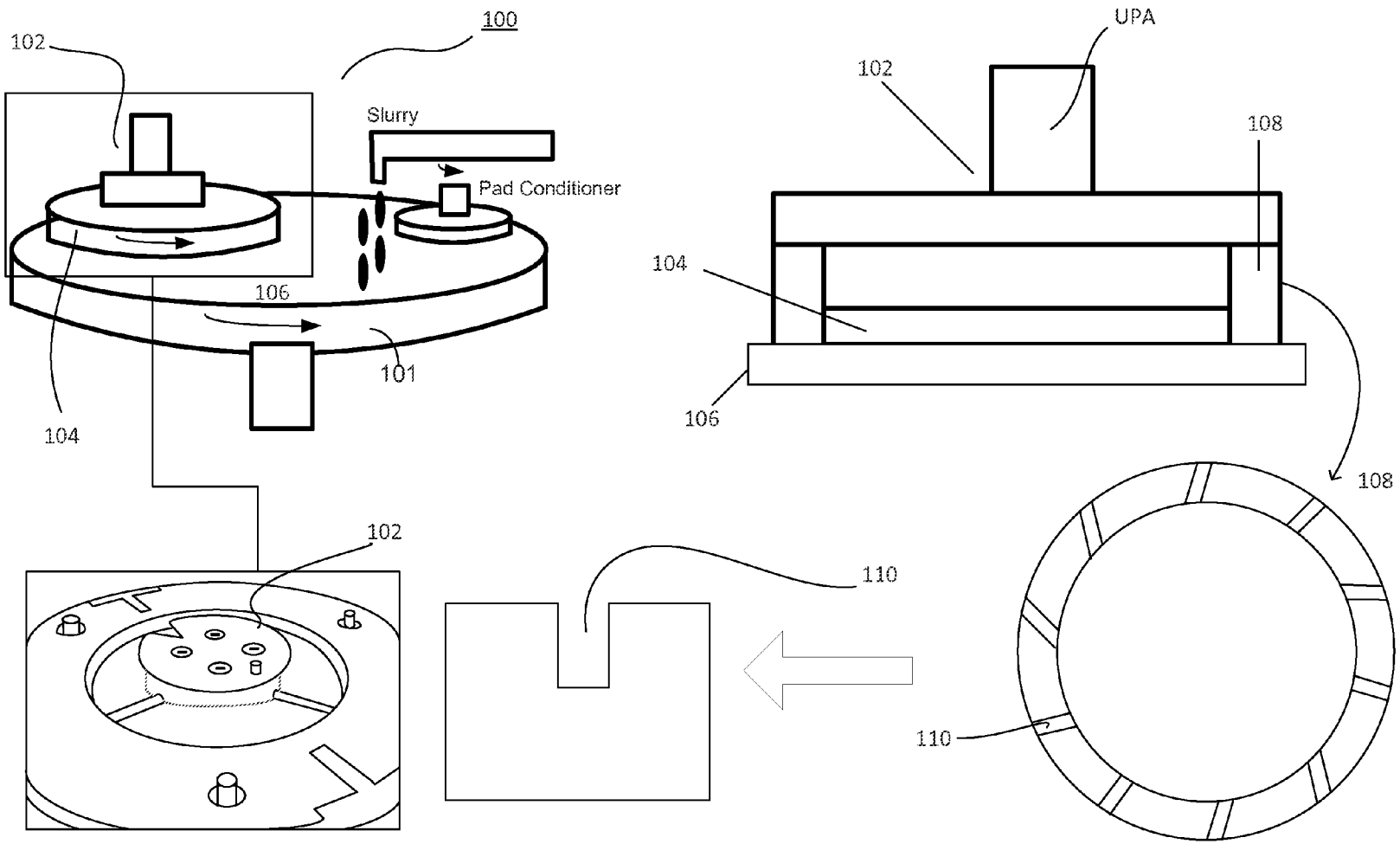
FIG. 1 shows side, top and cross-sectional views of an embodiment of a CMP structure.

Embodiments generally relate to CMP. FIG. 1 shows side, top and cross-sectional views of an embodiment of a CMP structure. The top left diagram in FIG. 1 shows a CMP structure 100 with a polishing pad 106 on a platen table 101, and a head assembly 102 holding a wafer 104 against the polishing pad with the wafer surface that is to be polished facing the polishing pad. During polishing, polishing head 102 presses the wafer 104 against the polishing pad while a retaining ring (not shown in this view) holds the wafer 104 in place by centering the wafer 104 on the polishing pad and preventing the wafer from slipping laterally.

The diagram directly below the top left diagram shows a top view of head structure 102. As this view shows the backside of head structure 102, the retaining ring is also not visible. Referring to the diagram on the top right of FIG. 1, a cross-sectional view of the CMP head structure is shown. Here, retaining ring 108 can be seen and as shown, during the CMP process, material is not only removed from the surface of the wafer planarized, but also from the side surface of the retaining ring 108. As can be seen, retaining ring 108 includes grooves 110, which are used for flowing in slurry and flowing out by products during CMP.

Figure 2:
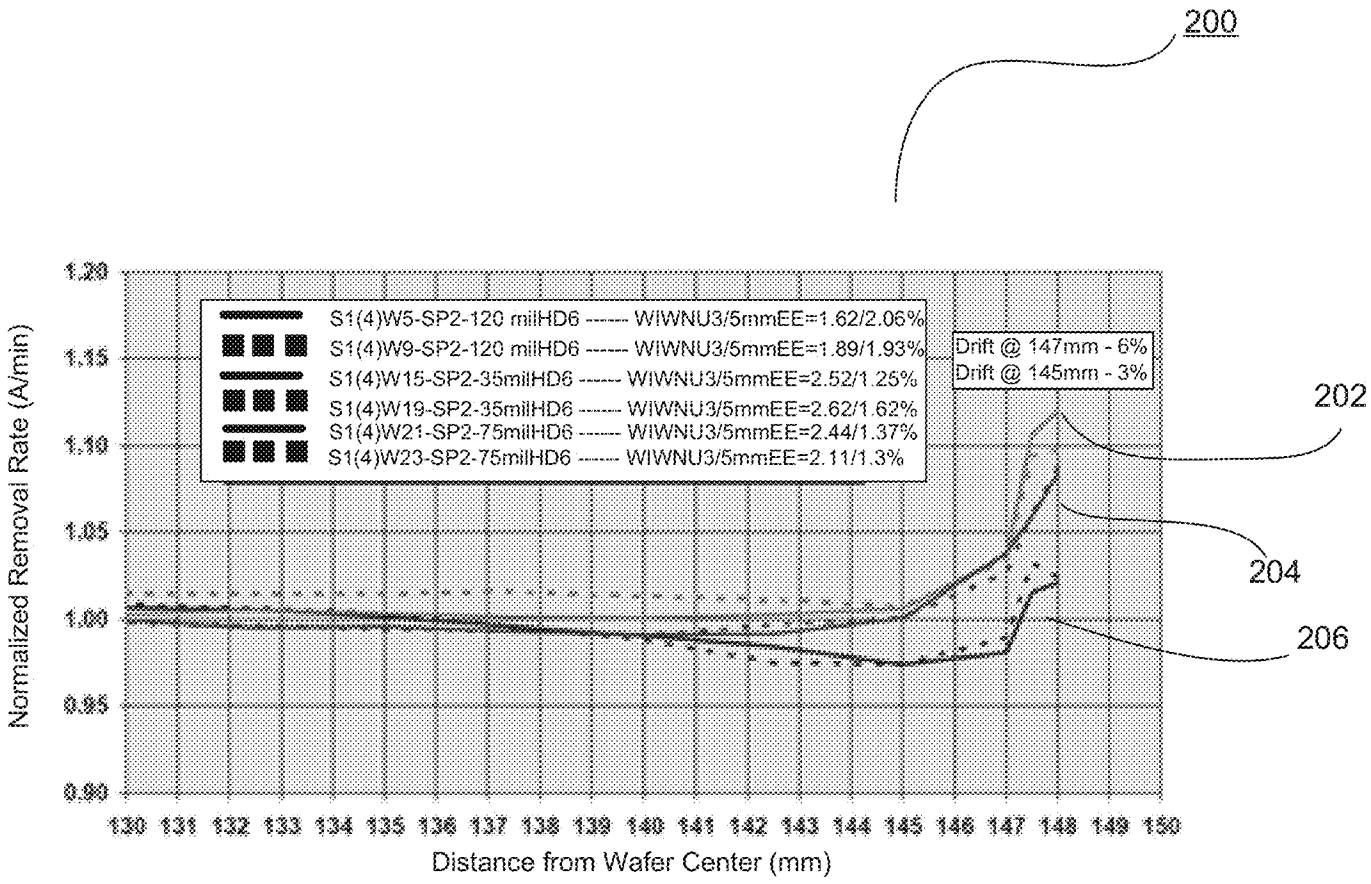
FIG. 2 shows a graph that illustrates the edge rate drift over the life of a retaining ring.

In view of the fact that retaining ring 108 material is also removed as wafer 104 is being polished, grooves on retaining ring 108 that are used for flowing in slurry may get worn out during the CMP process, thereby resulting in wafer edge profile change. Referring to FIG. 2, a graph 200 that illustrates the edge rate drift over the life of a retaining ring may be seen. A blank wafer is used in this study which measures the normalized removal rate of the wafer starting from about 130 mm from the center of the wafer to about 148 mm from the center of the wafer using an old retaining ring, a medium aged retaining ring and a new retaining ring. The old retaining ring may have a groove depth of about 35 mm, whereas the new retaining ring may have a groove depth of about 120 mm. The groove depth of the medium aged retaining ring may be any number roughly in between 35 mm to 120 mm.

The removal rate of the old retaining ring is shown by line 202; the removal rate of the medium aged retaining ring is shown by line 204; while the removal rate of the new retaining ring is shown by line 206. As can be seen, the difference of the removal rates of all 3 lines are fairly uniform initially, but as the distance from the center of the wafer approaches about 140 mm, the difference starts to widen and by about 145 mm from the center of the wafer, the drift is about 3 percent, whereas by about 147 mm from the center of the wafer, the drift is about 6 percent. Hence, there is a 6 percent increase in the normalized removal rate of the retaining ring as a new ring wears out and become old.

Figure 3:
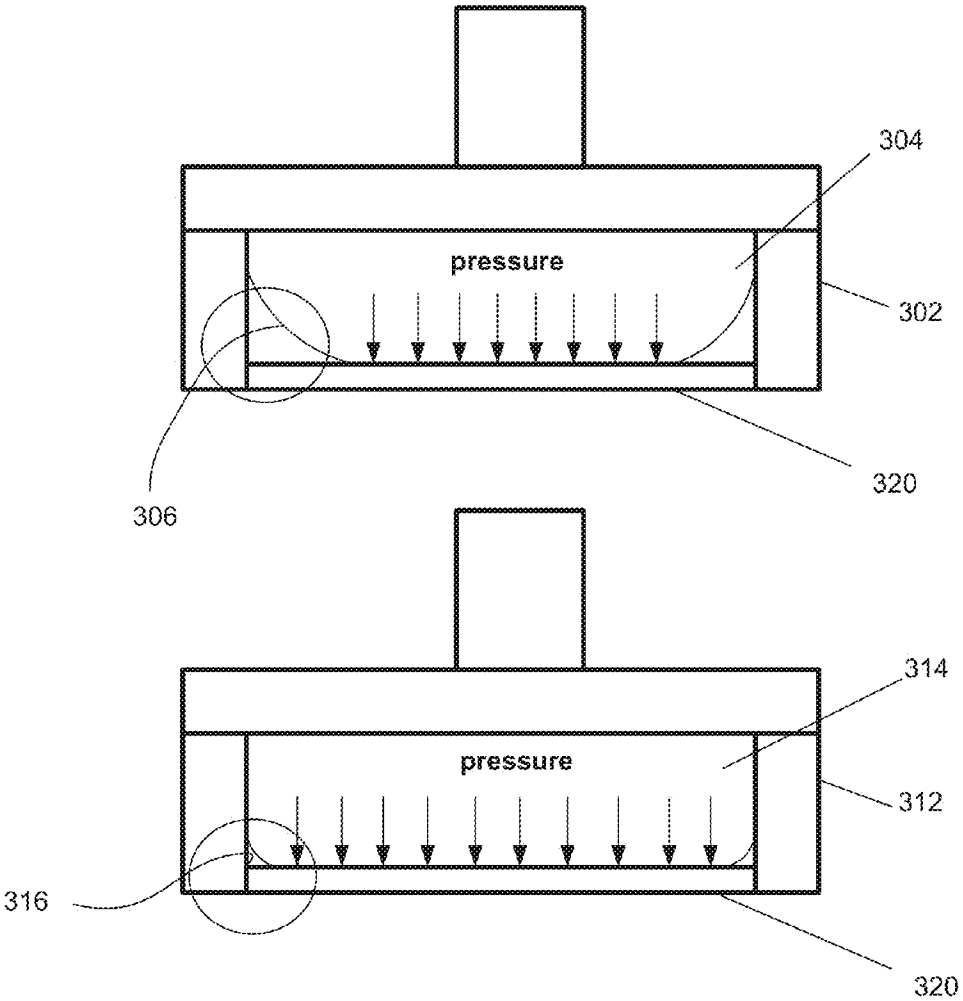
FIG. 3 shows a cross-sectional view of a new and old retaining ring, respectively.

FIG. 3 shows a cross-sectional view of a new and old retaining ring, respectively. As shown, the new retaining ring 302 has a corresponding membrane 304 that exerts pressure on wafer 320, while old retaining ring 312 has a corresponding membrane 314 that exerts pressure on wafer 320. As can be seen, the gap 306 between the membrane 304 and side of the new retaining ring 302 is larger than the gap 316 between the membrane 314 and side of the old retaining ring 312. As the gaps 306 and 316 correlate to the depth of the grooves on the retaining ring, this figure confirms that a new retaining ring has deeper groove depth than an old retaining ring and that as the ring wears out, the groove depth of the retaining ring becomes shallower. This results in the edge of the membrane being located closer and closer to wafer 320 and the tension exerted on the wafer eventually becomes compressive when inflated, which effectively leads to a higher down force towards the edge of the wafer as the retaining ring ages.

Figure 4:
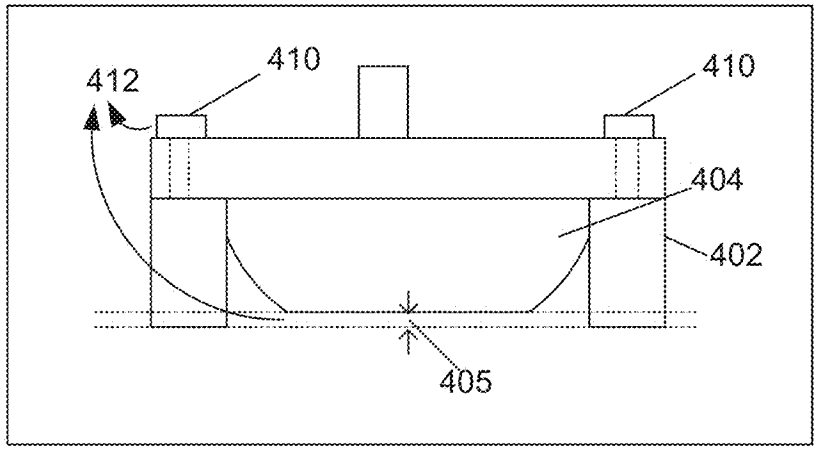
FIG. 4 shows a cross-sectional diagram of the step height between a retaining ring and its membrane.

FIG. 4 shows a cross-sectional diagram of the step height between a retaining ring and its membrane. Referring to FIG. 4, it can be seen that the step height 405 between a retaining ring 402 and its membrane 404 is of a first dimension $T_{RM1}$ when the retaining ring is new. The step height of $T_{RM1}$ may depend on the material used for the retaining ring and its membrane. The step height will change as the retaining ring wears out, and CMP process uniformity will change accordingly. The diagram also shows a controller 412 for monitoring the step height and a gear 410 for adjusting the step height 405, which is also connected to controller 412. In addition, while a gear is indicated in FIG. 4; in other embodiments, other mechanisms for adjusting the retaining ring movement thereby adjusting the step height may also be useful.

As the retaining ring ages, the step height will be reduced. When the controller detects that the step height has been reduced to a second dimension $T_{RM2}$, the controller 412 will automatically activate the gear 410 into drive to adjust the step height by moving the retaining ring so that the step height remains fixed at the same height before processing, i.e., at the first dimension $T_{RM1}$. In one embodiment, the retaining ring may include unfilled polyphenylene sulfide (PPS). Alternatively, the retaining ring may also include unfilled polycarbonate (PC) which encapsulates a stainless steel ring. In other embodiments, other materials may also be useful.

Figure 5A:
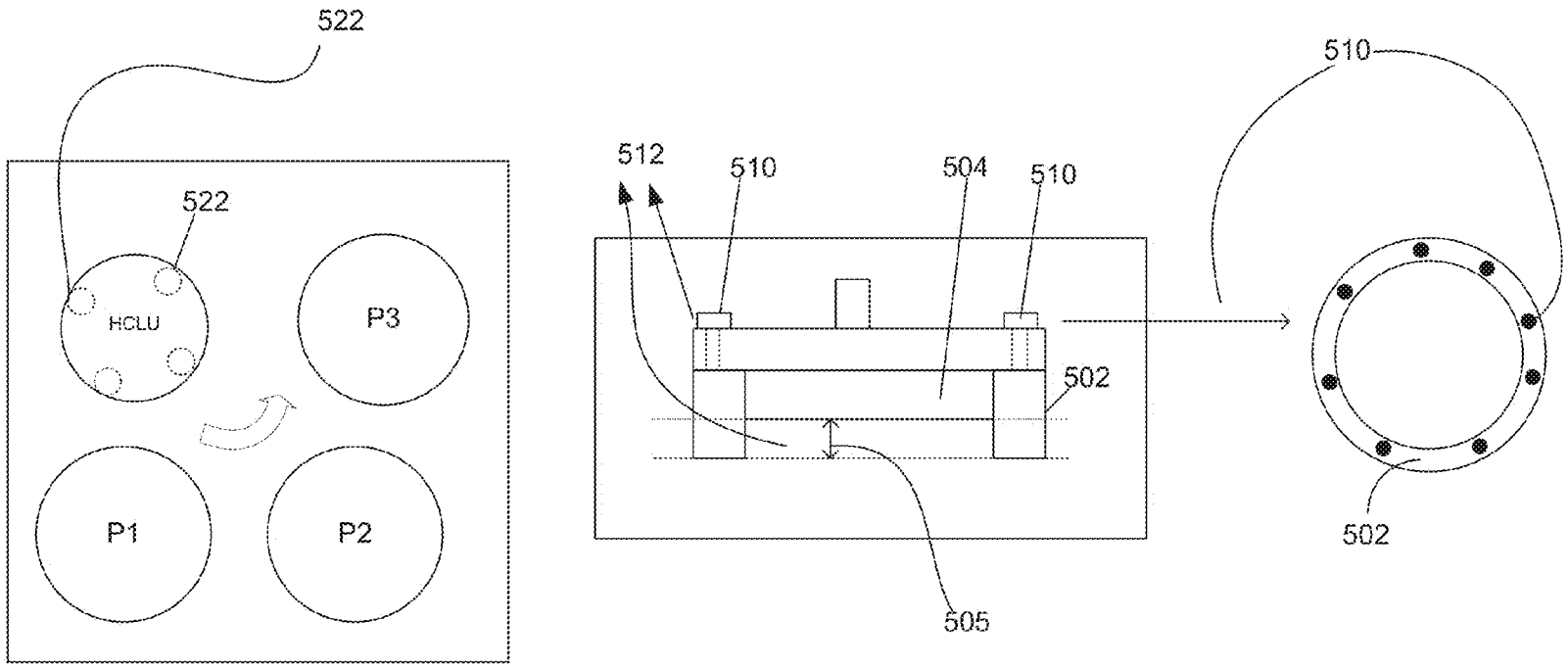
FIGS. 5(*a*)-5(*b*) show a method for monitoring and adjusting the step height between the retaining ring and its membrane to compensate for the aging/wearing out of a retaining ring.
Figure 5B:
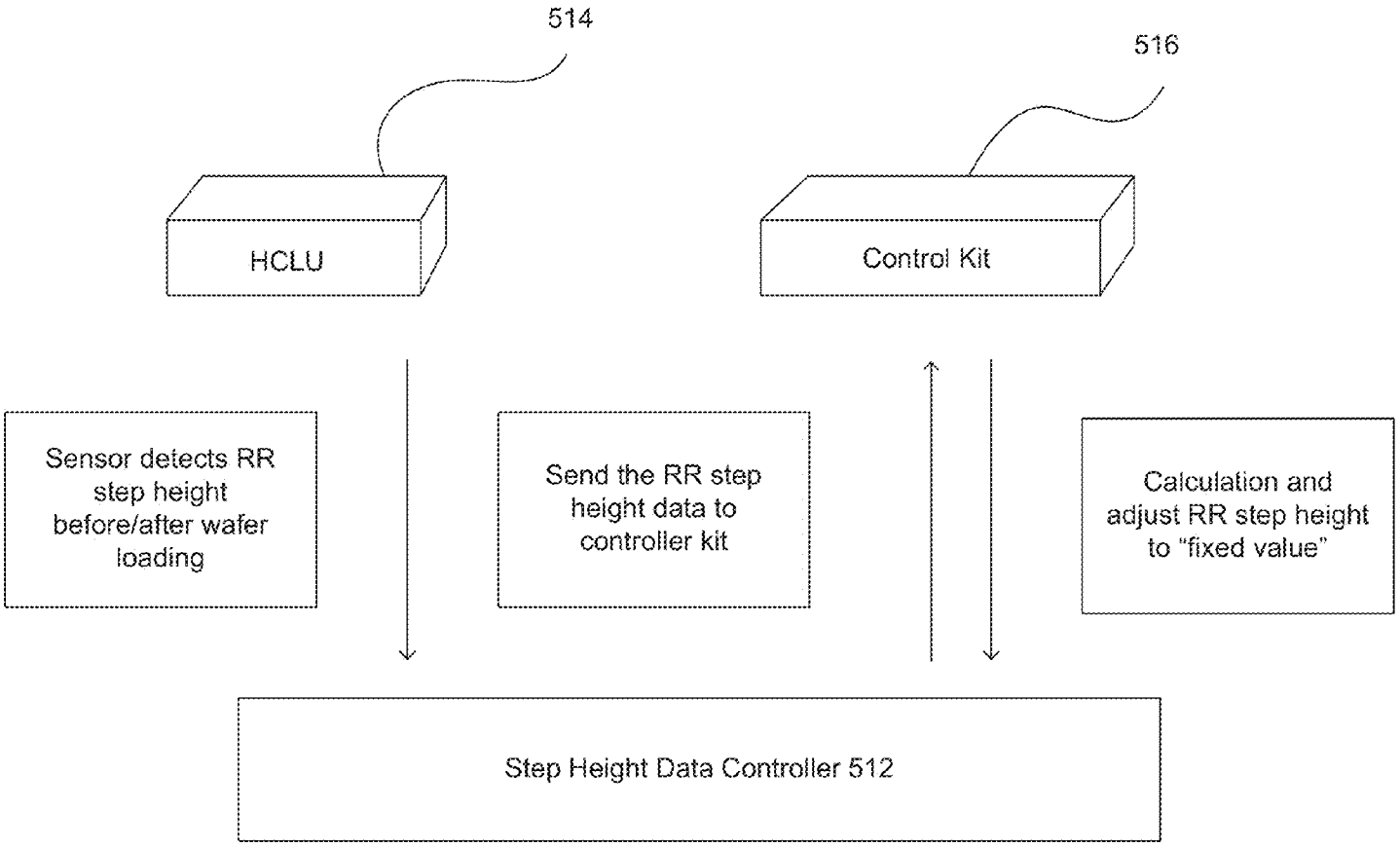

FIGS. 5(*a*)-5(*b*) show a method for monitoring and adjusting the step height 405 between the retaining ring and its membrane to compensate for the aging/wearing out of a retaining ring. Referring to the diagram on the left of FIG. 5(*a*), one or more ring monitoring equipment or sensors 522 may be installed at a head cup load unload (HCLU) to measure the step height between the retaining ring and the membrane before or after loading a wafer. The step height may be measured before a wafer or a batch of wafers is loaded onto the standard CMP equipment, which is depicted by P1, P2 and P3 in FIG. 5(*a*). The batch of wafers may have 50 wafers in a batch or 100 wafers in a batch. In other embodiments, the batch may include other numbers of wafers in a batch. In another embodiment, the step height may be measured after each wafer is processed or it may be measured after a batch of wafers has been processed.

The diagram in the center of FIG. 5(*a*) shows that a step height 505 exists between the retaining ring 502 and its membrane 504 before processing. A gear 510 is used for adjusting the step height 505 to ensure that it remains a fixed value throughout the life span of the retaining ring 502. The measurement of step height 505 and adjustment can be performed before or after wafer loading (before wafer processing). As can be seen in the diagram on the right of FIG. 5(*a*), where the retaining ring is shown in a top down position, gears 510 may be located around the circumference of the retaining ring 502 for adjusting the step height 505 between the retaining ring 502 and its membrane 504. In one embodiment, the gears may be set to be in drive mode at fixed intervals, e.g., every 500 wafers or 1000 wafers before processing. In another embodiment, the gears may be set to be in drive mode at fixed intervals while processing is taking place.

Referring to FIG. 5(*b*), a step height data controller 512 may be set up to monitor and control the step height between the retaining ring and its membrane. As shown, the controller 512 receives the measurement of the step height from HCLU 514 in the form of a digital signal. Controller 512 then sends the step height data to a control kit 516 by forwarding the digital signal received from HCLU 514 to control kit 516. Step height data controller 512 and control kit 516 can be merged as one unit or separate units. Control kit 516 will calculate the adjustment needed to keep the step height to a fixed value and send this information to step height data controller 512 and activate step height data controller 512 to adjust the retaining ring movement based on the data received. The retaining ring may be moved forward to ensure the step height remains at the original height when the retaining ring is new. Hence, the method ensures the step height between the membrane and the retaining ring will remain fixed to maintain stable CMP process profile as the retaining ring wears out.

The invention may be embodied in other specific forms without departing from the spirit or essential characteristics thereof. The foregoing embodiments, therefore, are to be considered in all respects illustrative rather than limiting the invention described herein. Scope of the invention is thus indicated by the appended claims, rather than by the foregoing description, and all changes that come within the meaning and range of equivalency of the claims are intended to be embraced therein.

What is claimed is:

1. A method for prolonging the use of a retaining ring comprising:

providing a head assembly for use in polishing a wafer, wherein the head assembly includes a retaining ring for holding the wafer in place on a polishing pad;

determining a step height between the retaining ring and a membrane of the retaining ring;

calculating how much the retaining ring should be moved to ensure the step height between the retaining ring and the membrane remains at a fixed value; and moving the retaining ring to ensure the step height remains at the fixed value as the retaining ring wears out.

2. The method of claim 1 wherein the step height comprises a first dimension before processing and the retaining ring is moved to ensure the step height remains at the first dimension throughout the retaining ring life span.

3. The method of claim 1 further comprising moving the retaining ring forward to ensure the step height remains at the first dimension.

4. The method of claim 1 wherein a controller activates a mechanism to move the retaining ring to ensure the step height remains at the fixed value.

5. The method of claim 4 wherein the mechanism comprises gears located around the circumference of the retaining ring.

6. The method of claim 5 further comprising setting the gears in drive mode at fixed intervals before processing.

7. The method of claim 1 wherein a controller calculates how much the retaining ring should be moved and activates a mechanism to move the retaining ring to ensure the step height remains at the fixed value.

8. The method of claim 1 wherein the calculating step further comprises receiving the measurement of the step height in the form of a digital signal;

forwarding the digital signal to a control kit that calculates the adjustment needed to keep the step height to a fixed value;

receiving the calculation of the adjustment needed from the control kit; and activating a mechanism to move the retaining ring so the step height remains at the fixed value throughout the retaining ring life span.

9. A method for forming a device comprising:

providing a wafer;

processing the wafer, wherein processing the wafer includes providing a head assembly for use in polishing the wafer, wherein the head assembly includes a retaining ring for holding the wafer in place on a polishing pad, determining a step height between the retaining ring and a membrane of the retaining ring, and calculating how much the retaining ring should be moved to ensure the step height between the retaining ring and the membrane remains at a fixed value, and moving the retaining ring to ensure the step height remains at the fixed value.

10. The method of claim 9 wherein the step height is of a first dimension before processing and the retaining ring is moved to ensure the step height remains at the first dimension as the retaining ring wears out.

11. The method of claim 10 further comprising moving the retaining ring forward to ensure the step height remains at the first dimension throughout the retaining ring life span.

12. The method of claim 9 wherein the calculating step further comprises:

receiving measurement of the step height in the form of a digital signal;

forwarding the digital signal to a control kit that calculates the adjustment needed to keep the step height to a fixed value;

receiving the calculation of the adjustment needed from the control kit; and activating a mechanism to move the retaining ring so the step height remains at the fixed value throughout the retaining ring life span.

13. The method of claim 9 wherein determining the step height is achieved by measuring the step height using a sensor or a plurality of sensors installed at a head cup load unload (HCLU).

14. The method of claim 13 wherein the calculation step further comprises:

receiving measurement of the step height by a step height data controller from the HCLU in the form of a digital signal;

forwarding the digital signal to a control kit that calculates the adjustment needed to keep the step height to a fixed value;

receiving the calculation of the adjustment needed from the control kit; and activating the step height data controller to adjust the retaining ring movement.

15. The method of claim 14 wherein the controller activates a mechanism for adjusting the step height to ensure it remains at the fixed value.

16. The method of claim 15 wherein the mechanism comprises gears located around the circumference of the retaining ring.

17. The method of claim 16 wherein the gears are set to be in drive mode at fixed intervals while processing takes place.

18. The method of claim 9 wherein the retaining ring comprises unfilled polyphenylene sulfide or unfilled polycarbonate which encapsulates a stainless steel ring.

19. The method of claim 9 wherein:

providing the wafer comprises loading the wafer onto a chemical mechanical polishing (CMP) tool; and determining the step height is performed before or after loading the wafer.

20. The method of claim 1 wherein the retaining ring comprises unfilled polyphenylene sulfide or unfilled polycarbonate which encapsulates a stainless steel ring.

* * * * *